US008869981B2

(12) United States Patent
Tang et al.

(10) Patent No.: US 8,869,981 B2
(45) Date of Patent: Oct. 28, 2014

(54) GOLF BAG HAVING ADJUSTABLE COMPARTMENTS

(75) Inventors: Larry G. Tang, Carlsbad, CA (US); David W. Cary, Temecula, CA (US); Hector D. Santana, Temecula, CA (US)

(73) Assignee: Callaway Golf Company, Carlsbad, CA (US)

( * ) Notice: Subject to any disclaimer, the term of this patent is extended or adjusted under 35 U.S.C. 154(b) by 450 days.

(21) Appl. No.: 13/344,489

(22) Filed: Jan. 5, 2012

(65) Prior Publication Data

US 2012/0187011 A1 Jul. 26, 2012

Related U.S. Application Data

(60) Provisional application No. 61/435,716, filed on Jan. 24, 2011.

(51) Int. Cl.
*A63B 55/00* (2006.01)

(52) U.S. Cl.
CPC ..... *A63B 55/00* (2013.01)
USPC ..... 206/315.6; 206/315.3; 206/315.8

(58) Field of Classification Search
CPC ..... A63B 55/00
USPC ..... 206/315.3, 315.6, 315.8
See application file for complete search history.

(56) References Cited

U.S. PATENT DOCUMENTS

| | | | | |
|---|---|---|---|---|
| 4,194,547 | A * | 3/1980 | Sidor et al. | 206/315.6 |
| 4,311,178 | A * | 1/1982 | Kennedy | 206/315.6 |
| 4,709,814 | A * | 12/1987 | Antonious | 206/315.3 |
| 5,458,240 | A * | 10/1995 | Rich et al. | 206/315.3 |
| 5,484,519 | A * | 1/1996 | Fenton et al. | 206/279 |
| 5,918,737 | A * | 7/1999 | Kwon | 206/315.3 |
| 6,935,496 | B2 * | 8/2005 | Chang et al. | 206/315.6 |
| D613,064 | S * | 4/2010 | Quartarone et al. | D3/320 |
| 2002/0179466 | A1 * | 12/2002 | Maeng | 206/315.3 |
| 2006/0108243 | A1 * | 5/2006 | Tan | 206/315.6 |

FOREIGN PATENT DOCUMENTS

JP 03247364 A * 11/1991

* cited by examiner

*Primary Examiner* — Tri Mai
(74) *Attorney, Agent, or Firm* — Rebecca Hanovice; Michael A. Catania; Sonia Lari

(57) ABSTRACT

A golf bag having adjustable dividers is disclosed herein. The golf bag of the present invention allows a user to arrange the adjustable dividers to create the size, configuration, and number of golf club compartments desired by the user. The dividers of the present invention are composed of interlocking, structural material to prevent golf clubs from getting tangled within the golf bag, and are assembled into an adjustable divider cartridge comprising a base retainer that is inserted into a golf bag. Once the divider cartridge is disposed within the golf bag, top retainers are added to retain the divider cartridge and prevent it from moving around within the golf bag.

7 Claims, 5 Drawing Sheets

GOLF BAG HAVING ADJUSTABLE COMPARTMENTS

CROSS REFERENCES TO RELATED APPLICATIONS

The present application claims priority to U.S. Provisional Patent Application No. 61/435,716, filed on Jan. 24, 2011.

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to a golf bag having adjustable internal dividers that permit the user to adjust the size, configuration, and number of golf club compartments. The present invention also relates to golf bag dividers composed of a lightweight, structurally rigid material that prevents golf clubs from getting tangled within the golf bag.

2. Description of the Related Art

Golf bags typically have multiple openings at their top of the bag into which golf clubs can be inserted. Most commercially available golf bags include full length fabric dividers, extending from the top of the bag to the base of the bag, that are designed to keep clubs or groups of clubs separate. These dividers are permanently affixed to the top and base of the bag. The fabric used to make these dividers is usually a flexible type that, while effectively separating the golf clubs inserted into the bag, often cause the golf clubs to get tangled or jammed within the golf bag, which can lead to club damage.

Golf bag designers and manufacturers dictate the number of compartments that golf bags contain and the arrangement and size of those compartments. Users must determine at the point of purchase the configuration and number of compartments that they want in their golf bag. If a golfer later changes his or her mind and would prefer a golf bag with more or fewer compartments, or compartments arranged in a different manner, he or she is forced to buy another golf bag with the desired configuration or cause damage to the bag by removing one or more permanently affixed dividers. This quickly can become expensive.

BRIEF SUMMARY OF THE INVENTION

The golf bag and golf bag dividers of the present invention allow users to arrange the number, size, and configuration of compartments in the golf bag. Users can add or subtract dividers without damaging the bag. The golf bag dividers of the present invention are also made of a lightweight structural material that prevents clubs from sticking or jamming when placed within the compartments.

One aspect of the present invention is a golf bag comprising a top collar, at least two divider panels, a base retainer having at least one base retainer opening, and at least one top retainer having at least one notch, wherein each divider panel has a top end and a bottom end, wherein the divider panels are removably attached to each other, wherein the at least one base retainer opening is sized to removably receive a portion of the bottom end of each of the at least two divider panels, and wherein the at least one notch is sized to removably receive a portion of the top end of each of the at least two divider panels.

In a further embodiment, each of the at least two divider panels comprises at least one longitudinal slot, and the at least two divider panels are removably attached to each other with the at least one longitudinal slot. The at least two divider panels may be composed of a lightweight structural material, which may be corrugated and rigid.

In one further embodiment, the at least one top retainer may be removably attached to the top collar, and the at least one top retainer may comprise a first opening at a first end and a second opening at a second end, wherein the first opening fits around a first protrusion on the top collar and the second opening fits around a second protrusion on the top collar. In a further embodiment, the first protrusion may be on a first side of the top collar, wherein the second protrusion is on a second side of the top collar, and wherein the first side is located opposite to the second side. In other embodiments, the base retainer may be removable and/or the top collar may be removable.

Another aspect of the present invention is an adjustable cartridge for organizing golf clubs comprising at least one first divider panel having at least one first longitudinal slot extending from a bottom of the first divider panel towards a top of the first divider panel, at least one second divider panel having at least one second longitudinal slot extending from a top of the second divider panel towards a bottom of the second divider panel, a base retainer having at least one opening sized to receive at least a portion of the bottom of the first divider panel and the bottom of the second divider panel, and a top retainer having at least one notch sized to receive at least a portion of at least one of the top of the first divider panel and the top of the second divider panel, wherein the adjustable cartridge fits within a golf bag when assembled. In a further embodiment, the base retainer and the top retainer may be molded and/or the first and second divider panels may be composed of a lightweight, rigid material.

Yet another aspect of the present invention is a method of assembling golf club compartments in an golf bag comprising providing a golf bag having a top opening, a top collar, and a base, providing a base retainer, at least one top retainer, and two or more dividers, connecting the two or more dividers to one another so that they delineate a desired number of compartments, inserting bottom portions of the two or more dividers into openings in the base retainer to form a divider cartridge, inserting the divider cartridge into the top opening of the golf bag so that the base retainer enters the golf bag first, sliding the divider cartridge into the golf bag until the base retainer makes contact with the base, and securing the divider cartridge within the golf bag by inserting at least a part of the top portion of at least one of the two or more dividers into at least one notch in the at least one top retainer and removably affixing the at least one top retainer to the top collar.

In a further embodiment, each of the two or more dividers may comprise a longitudinal slot, wherein a first longitudinal slot extends from a top portion towards a bottom portion of a first divider, wherein a second longitudinal slot extends from a bottom portion towards a top portion of a second divider, and wherein the connecting the two or more dividers comprises positioning the second longitudinal slot over the first longitudinal slot and fitting the two or more dividers together such that the first divider is oriented perpendicular to the second divider. In another embodiment, the at least one top retainer may comprise a first opening at a first end and a second opening at a second end, wherein the top collar comprises a first protrusion and a second protrusion, and wherein the first opening removably fits around the first protrusion and the second opening removably fits around the second protrusion. In yet another embodiment, each of the two or more dividers may be composed of a lightweight, rigid material, the top retainer may include a notch, and/or the top collar, the base, and the at least one top retainer may be molded.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

The present invention relates to a golf bag that allows a user to repeatedly adjust compartments for storing golf clubs. The golf bag includes dividers, which are interlocking and may be composed of hard durometer material. The dividers protect the club head shafts from tangling with each other and allow the user flexibility to arrange the number, size, and configuration of compartments as desired.

Figure 1:
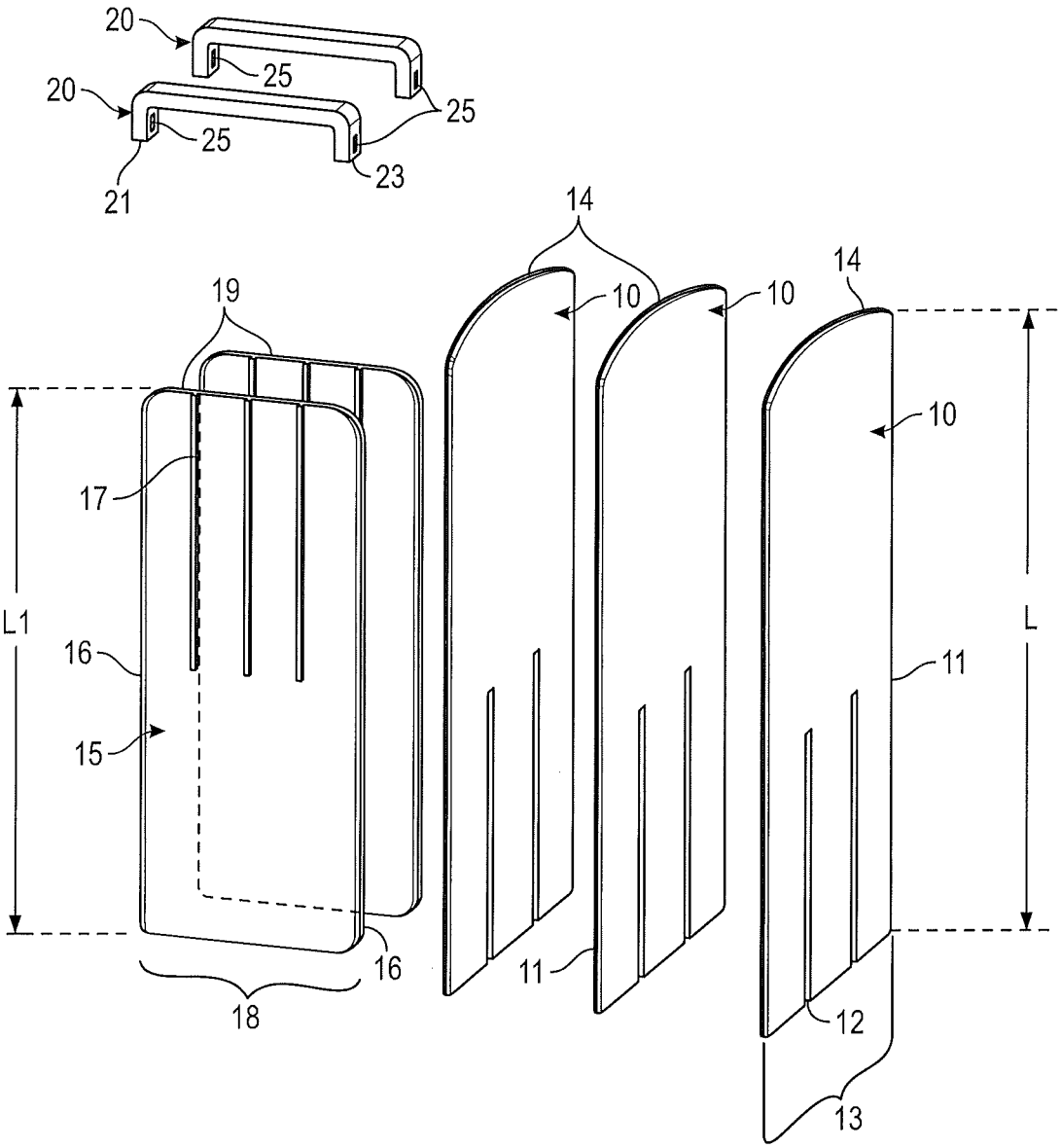
FIG. 1 is a side perspective view of golf bag dividers according to an embodiment of the present invention.

Elements of the preferred embodiment of the present invention are shown in FIGS. 1-4. As shown in FIG. 1, two types of dividers 10, 15 are provided. The dividers 10, are made of a lightweight, rigid material that preferably is corrugated to maintain structural integrity during use. The first type of divider 10 has slots 12 that originate at the bottom terminal edge 13 of the divider 10 and extend towards the top edge 14 of the divider 10. The slots 12 extend about halfway up the length L of the divider. In the preferred embodiment, and as shown in FIG. 1, the top edges 14 of the first type of divider 10 are rounded and have an arc-like shape. The second type of divider 15 has slots 17 that originate at the top terminal edge 19 of the divider 15 and extend towards the bottom terminal edge 18 of the divider 15. The slots 17 extend about halfway down the length L1 of the divider. In the preferred embodiment, the length L1 of the second type of divider 15 is shorter than the length L of the first type of divider 10. Also in the preferred embodiment, shown in FIG. 1, there are two dividers of the second type 15 and three dividers of the first type 10, for a total of five adjustable dividers 10, 15.

Also shown in FIG. 1 are two top retainers 20, each of which has a first and second end 21, 23. Each end 21, 23 includes an opening 25 that is used to removably affix the top retainers 20 to a top collar 40 of a golf bag 100, shown in FIG. 2. In the preferred embodiment, the top retainers 20 are molded from a polymer material, and have notches 22, 24, 26 sized to straddle top edges 14, 19 of the dividers 10, 15 and keep the dividers 10, 15 from moving. See FIGS. 4, 5C, and 6. In an alternative embodiment, the top retainers 20 may have slots or grooves (not shown) extending longitudinally along the underside of the top retainers 20, which are sized to snugly grip the top edges 14, 19 of the dividers 10, 15.

Figure 2:
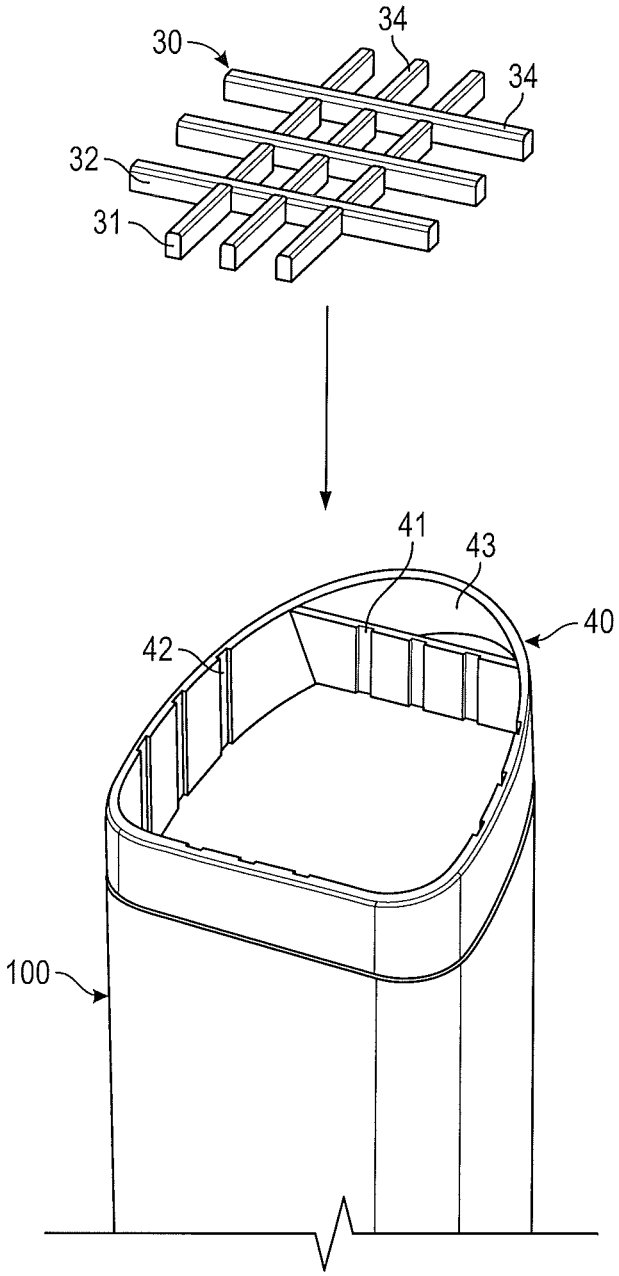
FIG. 2 is a side perspective view of a golf bag and bottom retainer according to an embodiment of the present invention.
Figure 3:
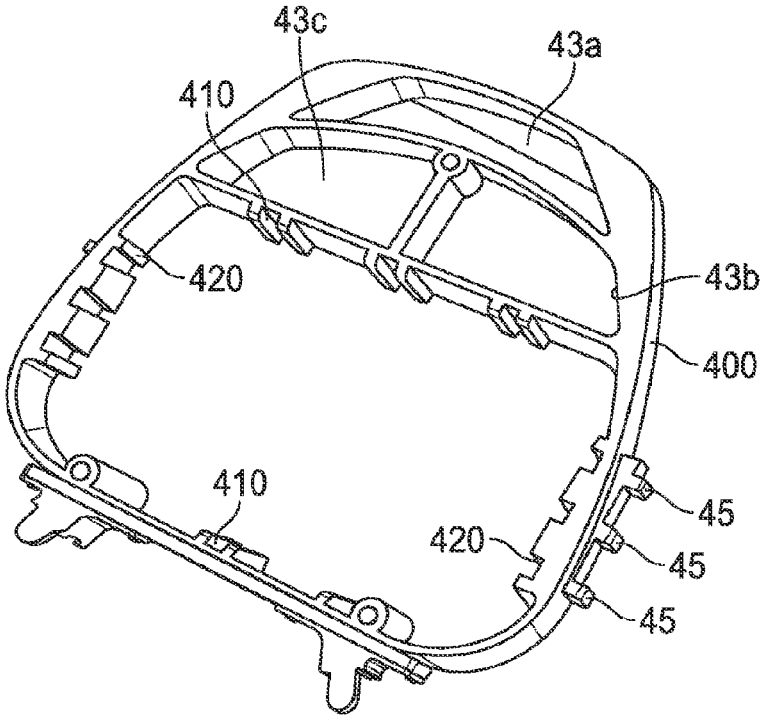
FIG. 3 is a top perspective view of a golf bag top according to an embodiment of the present invention.
Figure 4:
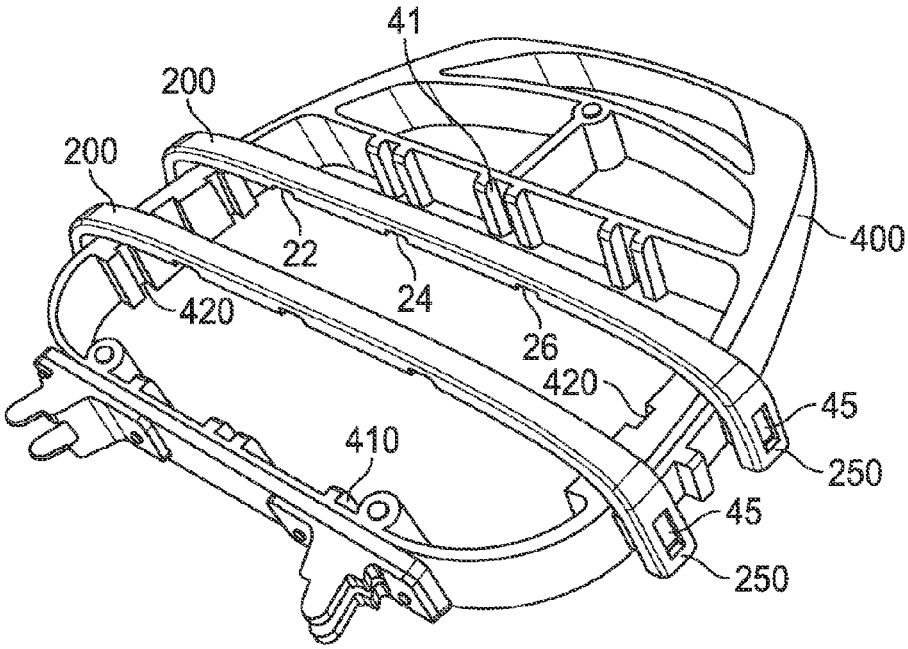
FIG. 4 is a top perspective view of a golf bag top according to an embodiment of the present invention.
Figure 6:
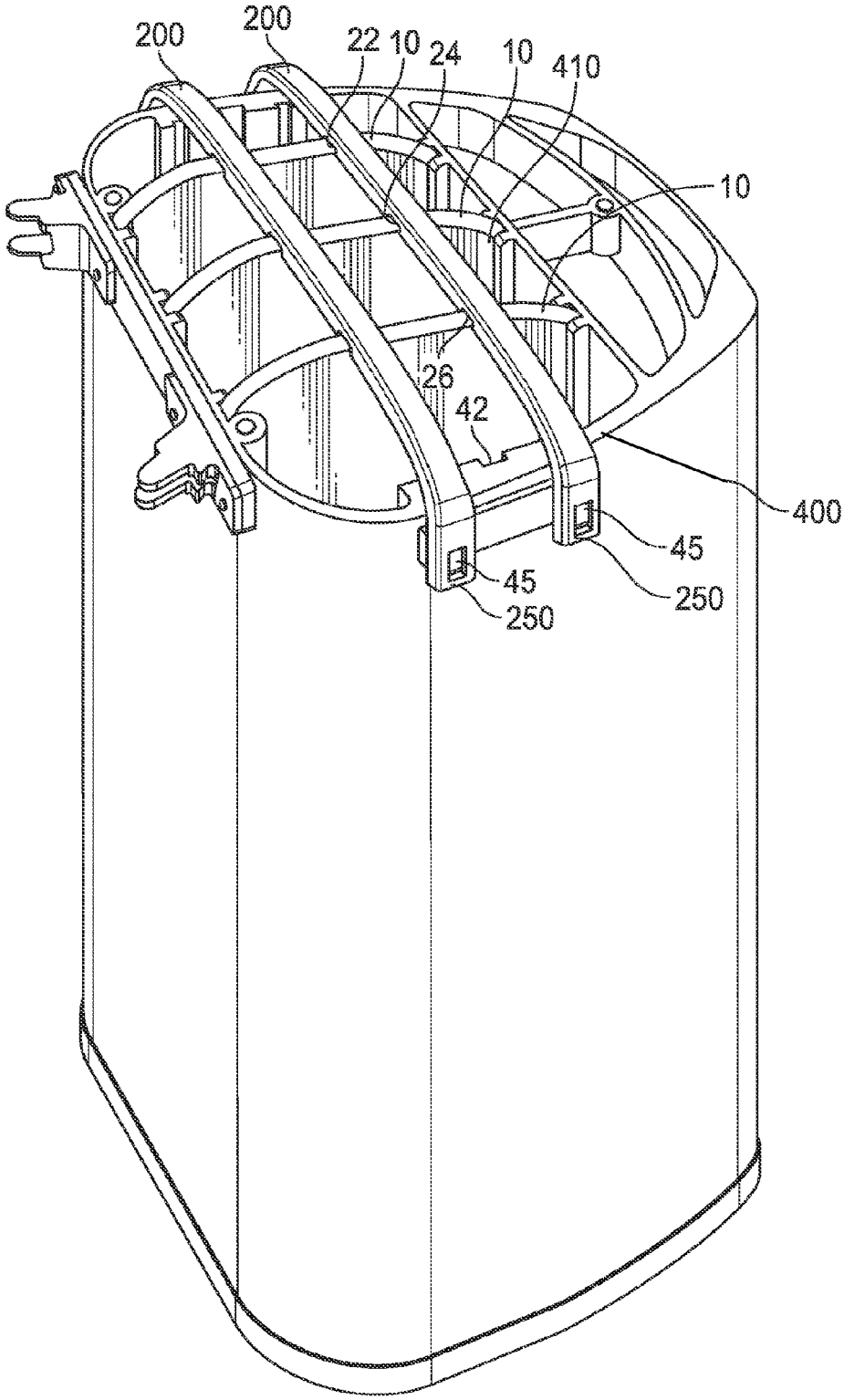
FIG. 6 is a side perspective view of a fully assembled golf bag of the present invention.

The top collar 40 of the golf bag 100, shown in FIG. 2, is preferably molded from a polymer material, such as plastic, but may also be composed of composite, metal, rubber, or other materials or combination of materials. As shown in FIGS. 2, 3, and 4, various iterations of the top collar 40, 400 include grooves 41, 410, 42, 420 on its inner side walls that are sized to receive the side edges 11, 16 of the dividers 10, 15. In the preferred embodiment, and as shown in FIG. 6, the grooves 41, 410, 42, 420 snugly receive the side edges 11, 16 of the dividers 10, 15, which are slid into the grooves 41, 410, 42, 420 during assembly. The grooves 41, 410, 42, 420 act as locators to retain the dividers 10, 15 and prevent them from moving.

In the preferred embodiment, and as shown in FIGS. 3 and 4, the top collar 400 also includes projections 45 from the outside side walls that extend away from the top collar 400, preferably perpendicularly. These projections 45 preferably are integrally molded parts of the top collar 400, but may be affixed to the collar after the collar is manufactured using adhesives, bolts or other types of affixing mechanisms. The projections 45 are sized to fit snugly within the openings 250 of the top retainers 20, 200 of the present invention. As shown in FIGS. 2, 3, and 4 the top collar 40, 400 may also include one or more pre-molded compartments 43, 43*a*, 43*b*, 43*c* for receiving clubs. These pre-molded compartments 43, 43*a*, 43*b*, 43*c* cannot be adjusted. In another embodiment, the top collar may not have any pre-molded compartments.

Also shown in FIG. 2 is a base retainer 30, which in the preferred embodiment has three shorter, straight bars 31 and three longer, straight bars 32, each of which has narrow, longitudinal slot or groove 34 in its center. The longitudinal grooves 34 on the bars 31, 32 of the base retainer 30 are sized to receive the bottom edges 13, 18 of the dividers 10, 15. In the preferred embodiment, the grooves 34 snugly receive the bottom edges 13, 18 of the dividers 10, 15, which are slid into the grooves 34 during assembly. When the bottom edges 13, 18 of the dividers 10, 15 are removably secured within the grooves 34 of the base retainer 30, the dividers 10, 15 are maintained a consistent distance apart and are restrained from moving.

Figures 5A, 5B, 5C, 5D:
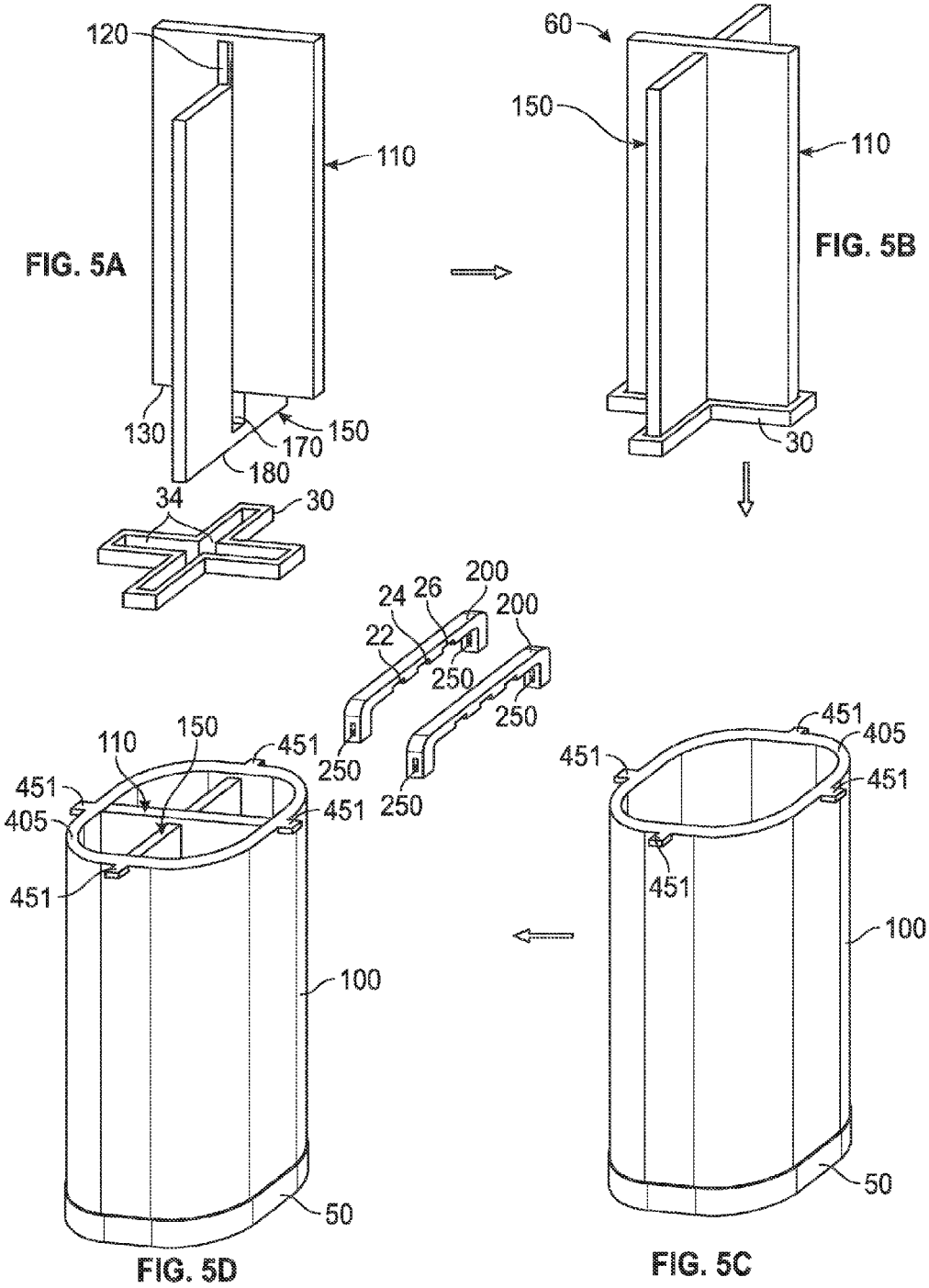
FIGS. 5A through 5D are step by step illustrations showing the assembly of an embodiment of the present invention.

The golf bag 100 of the present invention can be assembled quickly and easily by a user without the need for technical expertise or skill. As shown in FIGS. 5A-5D, which depict a simpler embodiment of the invention having only two dividers 10, 15, the dividers 10, are arranged so that they are perpendicular to each other and the slots 12, 17 of the dividers 10, 15 are aligned. See FIG. 5A. Divider 10 is pressed down onto divider 15 until the slots 12, 17 are completely interlocked, and then the bottom edges 13, 18 are inserted into grooves 34 in a base retainer 30. Once the bottom edges 13, 18 are securely gripped by the grooves 34, such that the combination of the dividers 10, 15 and base retainer 30 comprises a divider cartridge 60 as shown in FIG. 5B, the divider cartridge 60 is slid, base retainer 30 first, through the top collar 405 of a golf bag 100 into the golf bag 100. See FIG. 5C.

Once the base retainer 30 makes contact with the base 50 of the golf bag 100, top retainers 200 are attached to the top edges 14, 19 of the dividers 10, 15 and to the top collar 405. This is accomplished by placing one of the notches 22, 24, 26 over the top edge 14, 19 of one of the dividers 10, 15, and at the same time or sequentially sliding the openings 250 of the top retainers 200 over the projections 451 on the top collar such that the projections 451 are snugly retained by the openings 250. The notches 22, 24, 26 securely but removably grip the top edges 14, 19 of the dividers 10, 15. In this way, the top retainers 200 capture the dividers 10, 15 and prevent the divider cartridge 60 from moving around within the golf bag 100. This engagement is also shown in FIG. 6, which illustrates the collar 400 shown in FIG. 4 engaged with the dividers 10 shown in FIG. 1 and the golf bag 100 shown in FIG. 5D.

The method of assembling the golf bag 100 of the present invention described herein is applied to the preferred embodiment of the invention, which includes five dividers 10, 15, two top retainers 20, a five or six barred base retainer 30, and a molded top collar 400 having grooves 410, 42 and projections 450. A user can utilize this method to arrange the dividers 10, to have a desired size, configuration, and number of golf club compartments. If the user changes his or her mind about the golf club compartments, he or she can simply reorganize the dividers using the components and methods disclosed herein.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A golf bag comprising:

a bag body;

a top collar comprising an external surface, a first pre-molded compartment sized to receive one or more golf club shafts, and a second pre-molded compartment with an internal surface having a plurality of slots, each sized to receive a side edge portion of one or more divider panels;

at least two divider panels;

a base retainer having at least one base retainer opening; and at least one top retainer having at least one notch;

wherein each divider panel has a top end and a bottom end, wherein at least one divider panel has an arc-shaped top end, wherein the divider panels are removably attached to each other, wherein the external surface of the top collar comprises first and second protrusions, wherein the first protrusion is on a first side of the top collar, wherein the second protrusion is on a second side of the top collar, wherein the first side is located opposite to the second side, wherein the at least one base retainer opening is sized to removably receive a portion of the bottom end of each of the at least two divider panels, and wherein the at least one notch is sized to removably receive a portion of the top end of each of the at least two divider panels.

2. The golf bag of claim 1, wherein each of the at least two divider panels comprises at least one longitudinal slot, and wherein the at least two divider panels are removably attached to each other with the at least one longitudinal slot.

3. The golf bag of claim 1, wherein the at least two divider panels are composed of a lightweight structural material.

4. The golf bag of claim 3, wherein the lightweight structural material is corrugated and rigid.

5. The golf bag of claim 1, wherein the at least one top retainer is removably attached to the top collar.

6. The golf bag of claim 5, wherein the at least one top retainer comprises a first opening at a first end and a second opening at a second end, and wherein the first opening fits around the first protrusion on the top collar and the second opening fits around the second protrusion on the top collar.

7. The golf bag of claim 1, wherein the base retainer is removable.

* * * * *